US010072422B2

(12) United States Patent
Casey

(10) Patent No.: US 10,072,422 B2
(45) Date of Patent: Sep. 11, 2018

(54) EXPOSED STRUCTURE HEATING APPARATUS AND METHODS OF MAKING AND USE

(71) Applicant: Brian T. Casey, Tahoe City, CA (US)

(72) Inventor: Brian T. Casey, Tahoe City, CA (US)

( * ) Notice: Subject to any disclaimer, the term of this patent is extended or adjusted under 35 U.S.C. 154(b) by 450 days.

(21) Appl. No.: 13/853,794

(22) Filed: Mar. 29, 2013

(65) Prior Publication Data

US 2013/0319990 A1 Dec. 5, 2013

Related U.S. Application Data

(60) Provisional application No. 61/617,254, filed on Mar. 29, 2012.

(51) Int. Cl.
*E04D 13/10* (2006.01)
*H05B 3/06* (2006.01)

(52) U.S. Cl.
CPC ..... *E04D 13/103* (2013.01); *H05B 3/06* (2013.01)

(58) Field of Classification Search
CPC ..... E04D 13/103; E04D 13/0762; H05B 3/06
USPC ..... 219/213
See application file for complete search history.

(56) References Cited

U.S. PATENT DOCUMENTS 2,699,484 A * 1/1955 Michaels ..... E04D 13/0762 219/213
3,521,029 A * 7/1970 Tadao ..... E04D 13/10 219/201
4,081,657 A * 3/1978 Stanford ..... E04D 13/103 219/213
4,769,526 A * 9/1988 Taouil ..... E04D 13/103 219/213
5,391,858 A 2/1995 Tourangeau et al.
5,836,344 A * 11/1998 Hovi, Sr. ..... E04D 13/103 137/338
6,759,630 B1 * 7/2004 Tenute ..... E04D 13/103 219/213
6,852,951 B2 2/2005 Heise
8,607,509 B2 12/2013 Gurr
2006/0037252 A1 * 2/2006 Gosse ..... E04D 13/0762 52/11
2006/0288652 A1 12/2006 Gurr
2010/0024324 A1 2/2010 Meinzer
(Continued)

OTHER PUBLICATIONS

BYLIN Engineered Systems; Engineered Heating Cable Systems; Roof Ice Melt System; RIM Eave Panel—Class 1 Areas; 2013
(Continued)

*Primary Examiner* — Ibrahime A Abraham
*Assistant Examiner* — John J Norton
(74) *Attorney, Agent, or Firm* — Holland & Hart LLP

(57) ABSTRACT

Structure heating systems and methods of making and use. One embodiment has a unitary or integral roof edge heating element with a single heating cable mounted in a heating cable channel running laterally through the heating element and a roof edge heating panel extending from the portion of the heating element bearing the heating cable. Another embodiment includes a single heating cable mounted in a heating element surrounded by a heating element cover. Some embodiments can reduce the amount of heat transfer contact with supporting roof or adjacent structure, reducing heat transfer to the supporting roof or other adjacent structure.

9 Claims, 6 Drawing Sheets

(56) References Cited

U.S. PATENT DOCUMENTS

2011/0049118 A1* 3/2011 Nark ..... E04D 13/103
219/213
2011/0297662 A1* 12/2011 Clark ..... E04D 13/103
219/213
2012/0168419 A1* 7/2012 Bublitz ..... E04D 13/103
219/213

OTHER PUBLICATIONS

BYLIN Engineered Systems; RIM Eave Panel Data V13.
Non-final OA dated Jun. 19, 2013—an OA in co-pending U.S. Appl. No. 13/272,990. The instant application and the co-pending application both incorporate by reference U.S. Appl. No. 61/455,088.
SRH Roof and Gutter Deicing Cable; SHR RIM Data V14.
Winter Freeze Protection Solutions; Roof Ice Melt Systems—Recommended Specifications; Ice Dams and Icicles; 2013.
Internet Archive Way back Machine; 2013.
BYLIN Engineered Systems; Engineered Heating Cable Systems; Roof Ice Melt Recommended Specifications;2014.
BYLIN Engineered Systems; Winter Freeze Protection Solutions; Roof Ice Melt Systems—RIM Product; 2013.
BYLIN Engineered Systems, RIM2 Eave Panel Retrofit Installation, Apr. 30, 2001 The content of this document is prior art.
Thermal Technologies, T-1 Panel, Mar. 20, 2012.
Thermal Technologies, T1 Heated Eave Panel (8"). The content of this document is prior art.
Thermal Technologies, Installation Guide T-Panel System. The content of this document is prior art.
Thermal Technologies, Installation Guide T-Zone System. The content of this document is prior art.
Thermal Technologies, T-Panel Pamphlet. The content of this document is prior art.
Thermal Technologies, T3 Heated Eave Panel (18"). The content of this document is prior art.
Thermal Technologies, T2 Heated Eave Panel (12") . The content of this document is prior art.
Thermal Technologies, Heated Valley/Utility Panel. The content of this document is prior art.
Non-final office action dated Feb. 22, 2013—an office action in co-pending U.S. Appl. No. 13/211,175. The instant application and the co-pending application both incorporate by reference U.S. Appl. No. 61/455,088.

* cited by examiner

EXPOSED STRUCTURE HEATING APPARATUS AND METHODS OF MAKING AND USE

CROSS-REFERENCE TO RELATED APPLICATIONS

The present application claims priority through the applicant's prior provisional patent application, entitled HEATING ELEMENT, HEATING SYSTEMS USING SAME, AND METHODS OF MAKING AND USE, Ser. No. 61/617,254, filed Mar. 29, 2012, which provisional application is hereby incorporated by reference in its entirety. The present application also incorporates by reference in its entirety the applicant's prior provisional and non-provisional patent applications, entitled RADIANT ROOFING PANEL AND METHODS OF USE, Ser. No. 61/374,167, filed Aug. 16, 2010, ROOF DE-ICING APPARATUS AND METHOD OF USE, Ser. No. 61/455,088, filed Oct. 13, 2010, HEATING SYSTEM AND METHOD OF MAKING AND USE, Ser. No. 13/211,175, filed Aug. 16, 2011, and EXPOSED STRUCTURE HEATING APPARATUS AND METHODS OF MAKING AND USE, Ser. No. 13/272,990, filed Oct. 13, 2011. In the event, however, of any inconsistency between this application and any information incorporated by reference, this application shall govern.

FIELD OF TECHNOLOGY

The technology of the present application relates to heating apparatus for use on exposed structure and methods of making and use. In one particular embodiment, the technology of the present application relates to apparatus for reducing the formation of, or promoting of melting of, snow or ice on or adjacent a roof, along with methods of making and using such apparatus.

BACKGROUND

In many parts of the country, winter-like conditions deposit or form snow and ice on structures, such as roofs of buildings. As a result, snow and ice can pile up on a variety of structures, including roof eaves and intersecting valley areas of roofs. The accumulated volume and weight of ice and snow can cause serious, costly damage to the roofing and other structures.

In addition, as snow and ice melt (typically during the daytime), the resulting flow or dripping of water down or from the roof can form a wide variety of dangerous icicles and ice structures as temperatures later drop (typically in the evening and at night). The resulting icicles and ice structures often fall off the roof or other structures and cause serious damage to property as well as humans and animals.

Often, ice dams forms along roof eaves and intersecting valley areas. Such ice dams can form when: (1) snow accumulates on a roof; (2) heat escapes from the building's interior and melts accumulated snow; and (3) outside ambient temperatures are below freezing, which can cause the melting snow from the heated area to re-freeze along a cold overhang of the roof.

Ice dams can cause a wide variety of serious problems. For example, they can create standing water conditions above the ice dam at a roof overhang. This standing water can cause a variety of types of damage, whether due to weight of the water on the roof or water leakage into the structure or by sliding off of the roof.

These serious and dangerous problems obviously have existed for a very long time. A variety of electrical systems have been developed in the past to try to solve them.

In one prior art electrical system, a heat generating cable is placed along the roof edge, valleys, and other locations. Commonly, the cable is laid in a zig-zag configuration and is exposed and visible on the roof top. With such systems, much of the drip edge area remains unheated and can accumulate dangerous icicles and ice formations. Further, the cable is exposed to the elements, thus leading to ultraviolet degradation of the cable over time. The cable also typically is secured to the roofing by clips that are in turn fastened to the roofing by fasteners penetrating the roof. Commonly, these fasteners are also exposed, creating the risk of leaks. Heater cable can often be stripped off the roof by high winds or sliding snow.

One prior art system by Hot Edge, Inc., is disclosed in U.S. Pat. No. 8,191,319. This system includes a heat cable mounted along the fascia side of the roof to fascia corner. This is accomplished with a two- or three-piece assembly of thin sheet metal (typically low-conducting steel) attached onto the fascia. First, one sheet metal component is attached along the roof's eave and up the roof. A heater cable is mounted within the first sheet metal component, and the second sheet metal component is attached to the fascia plane and clamped to the first sheet metal component to surround the heater cable. This clamping is procedure is awkward and time consuming but is required to establish tight spring pressure contact and thermal conduction between the heater cable and the sheet metal components.

The Hot Edge's system parts are sized and formed depending on the angles of the roof and the fascias, so there are literally hundreds of different configurations from which to choose when ordering a system. The system includes differing structures for twelve differing roof slopes, and the system may be made with or without foam, round or oval holes or no holes at all, long or short fascia flanges, any of 14 colors, two metal thicknesses, and three kinds of metal. The manufacturer recommends purchaser buys and uses a digital protractor to determine the proper system components for a given application.

Many mistakes can happen between the ordering and manufacturing of the Hot Edge system. The installation is tedious and complicated. Errors can easily happen due to poor manufacturing and fit, resulting in poor heat conduction and poor ice melt performance. A broad upward flange of the first component sheet metal component reaches up along the roof with no attachment, which allows an unacceptable waviness (called "oil canning") in the metal, resulting in an unsightly appearance. The upward extending flange also renders the system vulnerable to damage resulting from wind, and sliding ice and snow.

Another prior art system by Tourangeau (see U.S. Pat. No. 5,391,858) includes a metal eave panel along the building eave with conduits into which heat cable is inserted. The metal components are made of light sheet metal, and the heat cable conduits are mechanically attached to the metal eave panel during installation. The prior art Tourangeau system is very difficult to install. The heat cable must be inserted into the conduit by pushing from one end. An average residential ice dam, however, may be 20' to 50' long or more. Inserting cable to penetrate such a structure is typically a difficult and time consuming task.

In addition, the cross-sectional size of the Tourangeau conduit must be loose enough to allow enough room for the cable to slide through the conduit. The excessive space in the conduit required for cable installation inherently leads to a reduction in heat transfer contact between the heater cable and the surrounding conduit, as the self-regulating heater drops down its output to around 50% if it is in "air." Further to this, sheet metal by itself is considered a relatively poor heat conductor. Securement to the roof is questionable, there is nothing discussed in patent about fastening to the roof; options are subject to ice movement and wind damage.

Yet another prior art system, the Bylin RIM System, consists of a single aluminum heating element mounted to a roof edge and a metal panel cover mounted over the top of the heating element. One lateral side of the heating element abuts and surrounds to some degree the roof edge, and the panel cover typically surrounds heating element, including a portion of the lateral side of the heating element surrounding the roof edge. The panel cover then extends upwardly across and in contact with the upper sides of the heating element and past the heating element upwardly along the roof. The upper portion of the panel cover extending upwardly along the roof is commonly secured to the roof by (i) mounting the upper panel portion on a section of the roof to be further covered by roof structure such as shingles, (ii) securing upper panel portion in place with fasteners penetrating the upper portion and roof support structure below, and (iii) then covering the upper panel portion by mounting shingles over it. A heating cable is mounted in serpentine fashion within three cable passages running along the entire length of the heating element. Thus the three lengths of heating cable heat the aluminum heating element, which in turn heats the panel cover to melt ice and snow in contact with cover.

The applicant has discovered and believes that the heating element of the Bylin RIM System presents a number of problems. They include, for example, that its heating element consists of two relatively thin, planar upper panel support and contact sections spanning between three spaced-apart heating cable channels extending downwardly from the upper panel support sections, and the downwardly extending channels also include, at their lower ends, planar roof contacting sections extending laterally from the lower ends. The relatively thin upper panel support sections, which span across the top of the heating element, can unduly warp, provide insufficient support to, and less than optimal contact with, the upper cover panel cover, and also insufficiently transfer heat through these sections to the upper cover panel. Also, the planar roof contacting sections provide heat loss by consuming heat themselves and also transferring heat to the supporting roof structure in contact with these planar roof contacting sections. In addition, this system provides less than possible heat transfer to its lower edge, which also is in contact with and intended to heat the lower edge of the upper cover panel surrounding that edge to a substantial degree. This also provides no electrolytic isolator to prevent corrosion when a copper cover is used to cover its aluminum heating element.

In another somewhat similar prior art system, by Thermal Technologies, includes a sizeable aluminum heating element that has both a substantial top and a substantial bottom section. The bottom section is secured to the roof by fasteners. The top section has two downwardly extending arms that clip within mating upwardly facing slots along the length of the bottom section. The top and bottom sections cooperatively provide four heating cable passages. Two of the passages are sized to accept one size of heating cable. The other two passages are adapted to accept a differing size of heating cable.

The applicant has discovered and believes that the Thermal Technologies system presents a number of problems too. For example, it is heavy and material intensive, which requires excess material and manufacturing costs. Also, when heater cable is mounted within it, its upper and lower heating element sections are spaced apart by the heater cable, and this leads to substantially reduced, or at least less than optimal, heat transfer from the heater cable to and across the upper heating element section as well as to the portions of the lower heating element section that contact the upper cover panel. In addition, the lower heating element section of this system has a large lower surface in contact with the underlying roof structure, causing heat loss by heating of this structure as well as by heat transfer to that contacting underlying roof structure. Further, this system also provides less than possible and desired heat transfer to its lower edge, which also is in contact with and intended to heat the lower edge of the upper cover panel surrounding that edge to a substantial degree.

Other problems with this system include, for example, its upwardly facing slots, into and through which water can leak and debris can accumulate, which can cause accelerated rotting of the heating cable. Similarly, by providing so much contact between the heating element and underlying roof structure, this system can cause water and humidity to build up in that contact area over time, leading to various problems such as dry rot of adjacent roof materials and corrosion or loosening of the roof attachment fasteners securing the heating element fasteners to the roof.

Another prior art ice prevention system is the Zmesh system from Heatizon (see U.S. Pat. No. 4,581,522). The Heatizon system includes a heatable wire screen installed onto the roof deck and under the roofing materials. In retrofit situations, installation requires removal of the existing roofing, adding to the labor and materials cost. The Heatizon parts are expensive, and the large low-voltage transformers used fail over time; replacement is very expensive. Due to the nature of the installation, the screening is applied under roofing directly onto the roof deck support surface, resulting in a substantial loss of heat down through the cold overhang. Further, when a fastener penetrates both the screening and a metal roof flashing (such as edge trim, valley metal, and plumbing/heating flashings) the system can short out and become inoperable. Further, the Heatizon system utilizes costly additional plies of waterproof roof membranes needed to meet installation requirements. Rooftop installation requires soldering the screening to heavy plate, adding to installation time and opens the possibility of faulty connections. Repair of the Heatizon system requires roofing removal. In addition, due to the folding of the Heatizon screening required at ends of the roof, some roof areas are not heated properly and re-freezing occurs at the eave edge.

Heat from the Heatizon screening must be conducted through the roofing materials. Shingle roofing, however, is not a good conductor, and so the Heatizon system must utilize a large amount of energy to generate the heat needed to reach the melting surface.

Installation requires extending the heatable screen from the eave edge to several feet up the roof surface from the eave edge. It is costly to heat such a broad area, particularly by heating through the roofing material.

Heatizon's prior ice melt system for metal roofs uses a heater wire embedded into a heat sink. This creates an uneven roofing surface at the top edge of the heat sink. It is also expensive to purchase, install, operate, and repair if necessary.

Another prior art system by Heated Roof Panels (see U.S. Pat. No. 7,121,056) uses a principle similar to Heatizon above. This system provides a heatable silicone pad installed onto the roof deck under the roofing. As noted above, this makes installation onto an existing roof very costly due to removal and replacement of the roof. In addition, under-roofing heating elements are an inefficient and costly to operate. This method also suffers not only must generate enough heat to transfer through the upper roofing structure but also incurs heat loss downward through the roof deck into the cold overhang.

The Heated Roof Panel system also uses an expensive underlayment. Typical heater pads are 10"×6', 8', and 10.' Installers are prohibited from penetrating the pad with roofing fasteners, as doing so permanently damages the heater pad and renders it inoperable. Shingles are applied in horizontal rows (courses) with approximately 5" exposure. Shingle nailing also corresponds with this 5" course. Therefore, proper shingle nailing (as required by the shingle manufacturer and thus the building code) require penetrating and damaging the heat pad. The manufacturer's proposed solution instructs use an adhesive to attach the shingles over the pads in lieu of nailing. Such a solution can be a violation of the building code. It also makes the roofing shingles more vulnerable to wind blow-off (more common along the roof's perimeter, and where the heat pads are used), and susceptible to damage due to moving ice and snow. Plug-in connections below the roof surface could have problems, and any repair of this device would require expensive removal of the roofing system. Installation requires application from the eave edge to several feet up the roof. Heating this broad area is costly.

The prior art Step De-icing system (see U.S. Pat. No. 5,961,869) is much like the Heatizon and Heated Roof Systems and includes a heating element applied under roofing. It shares the same energy inefficiencies due to inordinate heat loss downward through cold roof overhangs and using a poorly conductive element (such as roofing shingles) to conduct heat to the snow surface. Installation on an existing roof requires removal and replacement of the roofing, and any repairs would also require roofing removal.

This Step De-icing product is made of plastic. It has bus wires that carry the current through the system. When these bus wires are damaged (cut on flashings, penetrated with a roofing fastener, etc.), the system is rendered inoperable. Like the Heatizon system, the Step De-icing system requires expensive transformers that wear out and eventually need replacement. Further, the maximum length possible on one circuit is 33 square feet, which make installation of longer lengths more complicated and time consuming. Similarly, installation requires application from the eave edge to several feet up the roof. This broad area is costly to keep heated, and many circuits and transformers are required for even a small job.

Yet another prior art system is the applicant's Radiant Edge system. The applicant believes that the Radiant Edge system was and is a major advance in the state of the art, but it is a heavy duty system that utilized multiple runs of heating cable through multiple heating cable channels in its heating element. It is also relatively heavier and larger than desired to meet cost, shipping, and structural support objectives in certain applications. Further, it does not allow for easy insertion of, or access to, the heating cable after installation of the heating element cover.

BRIEF SUMMARY OF SOME ASPECTS OF THE DISCLOSURE

There are a variety of aspects of the present disclosure. In aspect, the applicant has provided a cable heated system for mounting on building or structure having only heating cable channel. In some embodiments, the one heating cable channel is mounted a portion of the system adjacent a building or structure edge, such as a roof eave for example.

In certain embodiments, the system has one heating channel extending laterally along a building or structure edge. This can allow use of substantially less cable material to heat a roof edge.

In another aspect, some embodiments expand the amount of heating element surface facing away from a support surface (such as a roof for example) as compared to the amount of heating element surface in contact with the support surface or other surfaces in the vicinity of the heating system.

Certain systems provide a heating cover including a heat cable channel with the heating element cover. Some instances of a roof heating portion of these systems can consist of only the heating cover, a fastener, and the heating cable mounted in the heating cover. In some embodiments, the heating cable can be directly mounted within the heating cover itself.

Some embodiments of such a heating cover can consist of a laterally extending cover sheet section with a thickened edge section with the cable channel running laterally through the thickened section. Embodiments of this system can be particularly economical, lightweight, efficient, and easy to assemble and maintain.

In yet another aspect, the heating system can include a roof edge seal to seal out the elements from the lower heating system surface and an adjacent upper supporting surface.

Certain embodiments can also include thickened edge structure. The thickened edge structure can be stronger and support, for example, substantial weight placed on the structure. In some embodiments, the cable channel can penetrate this thickened edge structure.

In some instances, the heating system provides a relatively smaller, low profile structure. Some embodiments are lighter in weight. In some embodiments, this, and other aspects if utilized, can variously make the system less expensive to ship, easier to assemble, and less stressful on underlying supporting structure.

In some embodiments, the heating apparatus includes a metal heating element, and metal upper cover panel, and a heat source. In some embodiments, the heating element is a heater cable. Other heat sources may be utilized, such as hot water.

Similarly, various of the heating apparatus may be combined with a solar or other energy generating system. In the case of a solar system, for example, some embodiments may for example provide to, or utilize from, a heated fluid or other energy from the solar system.

In some embodiments, the heating apparatus may include liner, paint, or other separating or insulating structure to, in some embodiments, reduce or prevent contact between dissimilar metallic or conductive components, or between the heating apparatus and other structure. In some embodiments, the heating apparatus may include other insulating or supporting components. In certain embodiments, insulating material may be mounted in spaces between the heating element and underlying structure, which may be a roof or other surface. In certain embodiments, insulating material may be mounted between the upper cover panel and roof or other structure.

In some instances, exposed portions of the heating apparatus as installed may be painted. Metallic paint may also be used on, for example, the upper or exposed surface of the cover panel.

In some instance, the heating system provides for insertion of the heating cable after mounting of the entire heating element, and heating cover if applicable. In some embodiments, this is accomplished by having the heating element channel exposed after installation of such structure, such as by having the heating cable channel extending from an exposed, uncovered lip section of the heating element. In some embodiments, this exposed section can face inwardly, toward the edge of adjacent structure such as a roof edge, and thus be protected from exposure to the sun, wind, rain, and snow by the surrounding lip section and/or heating element cover.

In this regard, it is to be understood that embodiments of the heating apparatus may be mounted to or adjacent roof structure. The heating apparatus may also be mounted to or adjacent other structure or physical material, and in such case the reference to a "roof" in this specification would mean or include such other structure of physical material.

In certain embodiments, the heating apparatus may include additional features. One such feature is additional heating cable or other heat source for extension into, adjacent, or abutting other structure, such as, in some instances, a gutter or roof valley. Another such feature includes flashing or other panel or heating element structure for extension into, adjacent, or abutting other structure.

There a variety of methods of use provided by the various structures disclosed in this application. In some embodiments, the method can include:

1. mounting a heating element to a roof, in some instances adjacent and surrounding somewhat a roof edge; and
2. mounting a single heater cable in mating passages in the heating element:
3. when applicable for the embodiment, mounting a cover panel to generally surround the heating element, and in some embodiments, extend over portions of the roof or otherwise beyond contact with the heating element.

In some embodiments, the method of use can be even simpler:

1. mounting a heating cable in a heating cover element; and
2. mounting the heating cover element with cable onto an underlying structure.

Alternatively, some embodiments of the method can support first mounting the heating cover element and then inserting the cable in the heating cover element after it is mounted in place.

In some embodiments, the heating apparatus can provide one or more of a more robust, more efficient, or easier to manufacture, transport, install, or maintain heating apparatus or aspect of such an apparatus. In some embodiments, the heating apparatus can also or in the alternative cost much less to manufacture, transport, install, operate, and maintain.

In some embodiments, the heating apparatus (1) conducts heat from self regulating heater cable(s) more efficiently to the top surface of the apparatus to melt ice and snow; and/or (2) conducts heat from the heater cable(s) more efficiently to the drip edge of the device to melt ice and snow; and/or (3) reduces heat loss by reducing the surface area that bears on the roof.

In some embodiments, the heating apparatus can utilize from up to 50% less energy than prior heating apparatus, such as the prior art Radiant Edge system. In some instances, the heating element provide more heat transfer material mass, which in some embodiments can conduct the heat where it is needed, and, in turn, reduce heat loss in locations where it is not needed.

It is to be understood that this Brief Summary recites some aspects of the present disclosure, but there are other novel and advantageous aspects. They will become apparent as this specification proceeds.

It is also to be understood that aspects of the present disclosure may not necessarily address one or all of the issues noted in the Background above. The scope of the present invention is thus to be determined by the claims as issued and not whether they address issues noted on the Background or provide features recited in this Brief Summary.

BRIEF DESCRIPTION OF THE DRAWINGS

The preferred and other embodiments are shown in the accompanying drawings in which.

DETAILED DESCRIPTION OF THE PREFERRED AND OTHER EMBODIMENTS

Heating apparatus and methods of use are described. Although the heating apparatus is described primarily in the context of the roof structure shown, it should be appreciated that the referenced structure, concepts, and features may be used in a variety of other settings or structures that would be recognized by those of ordinary skill in the art. Also, it should be understood, that the features, advantages, characteristics, etc., of one embodiment may be applied to any other embodiment to form an additional embodiment unless noted otherwise.

Figure 1:
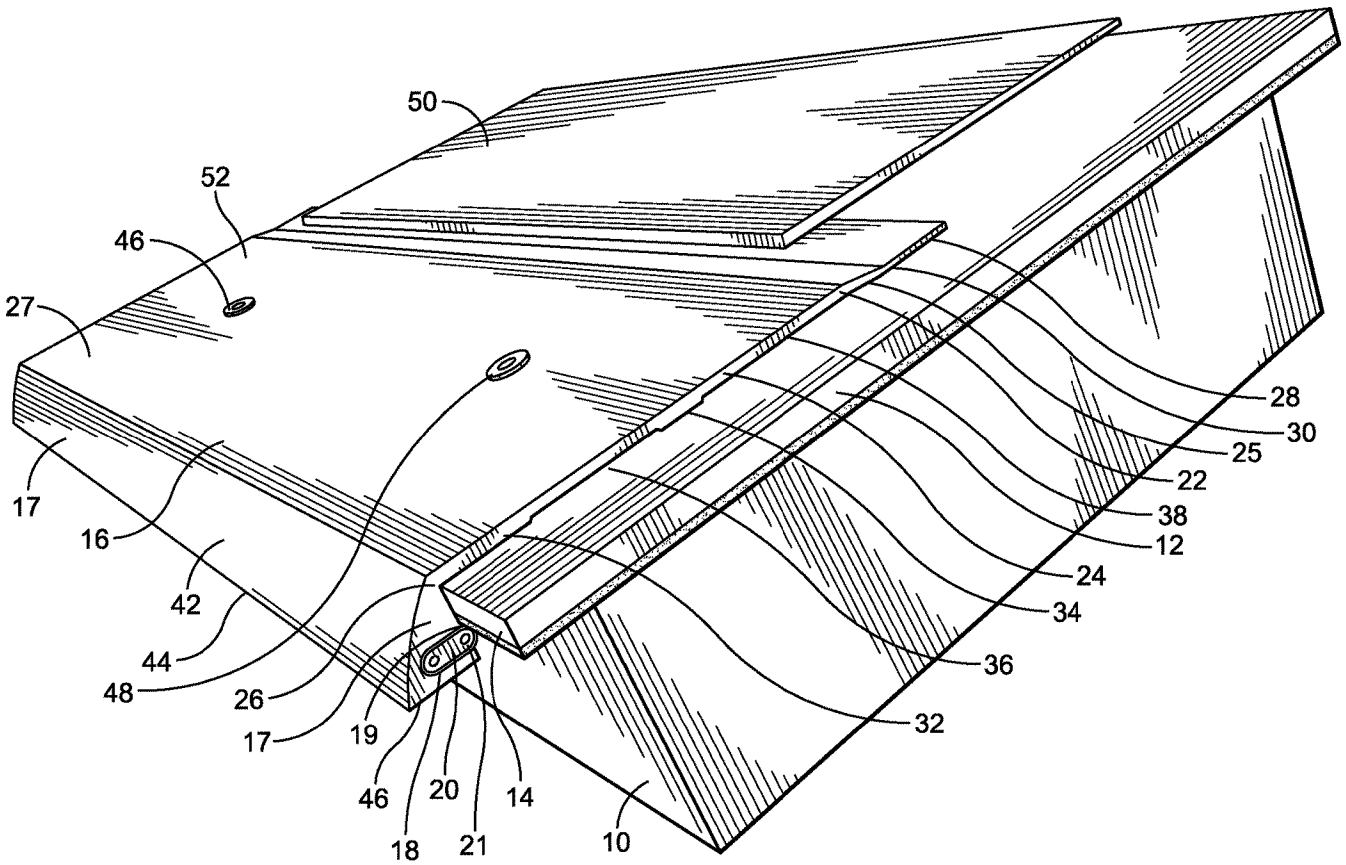
FIG. 1 is a perspective, partially cross-sectional view of a unitary heating cover embodiment of a structure heating system mounted about a roof edge on the roof of an underlying house.

With reference now to FIG. 1, one embodiment of a building, generally 10, has a sloped roof 12 with a lower roof edge 14 extending along the lower most portion of the roof 10. A laterally extending heating element 16 is mounted along the lower roof edge 14. The heating element 16 has a laterally extending thickened outer section or flange 17 having a laterally extending heating cable channel 18 with a heater cable 20 mounted within and penetrating the outer U-shaped heater cable channel 18 along the entire lateral length of the heating element 16. In this embodiment, the outer end 21 of the heater cable 20 is spaced from the lower roof edge 14 to allow the heating cable 20 to be mounted within the heating cable channel 18 after the heating element 16 is mounted on the roof 12. In other embodiments, however, an outer end 21 of the heater cable 20 can extend slightly outwardly from heater cable channel 18 to abut the lower roof edge 14, which can bias the cable 20 into tight contact with surface of the heater cable channel 18 as well has help create a seal between the roof edge 14 and the abutting edge abutting end 19 of the heating element flange 17.

A heating panel 22 extends transversely from the upper edge 24 of the outer flange 17. The heating panel 22 has a central panel section 24 extending from the outer flange 17, a downwardly sloped panel section 25 extending from the central section 24 opposite the junction 26 with the outer flange 17, and an outer panel section 28 generally parallel to the plane of the central panel section 24 extending from the end 30 of the downwardly sloped panel 25. The central panel section 24 has a generally planar upper surface 27.

The central panel section 24 has relatively thicker laterally extending lower support section 32 and thicker laterally extending central support section 34 as compared to a substantially thinner (i) laterally extending intermediate section 36 between the lower support section 32 and the central support section 34, and (ii) upper end section 38 extending from the central support section 34. On some embodiments, the intermediate section 36 and upper end section 62 are 30-75% thinner in cross-sectional thickness than the lower support section 32 and central support section 38. One exemplary thickness of intermediate section 32 and upper end section 62 is 0.100 inches, with the exemplary thickness of the associated lower support section 32 and central support section 38 at 0.140 inches. The percentage difference can be other than 50%, however. In some embodiments, there may be no percentage difference, and thus the percentage difference could range from 0% up the highest number providing any needed structural integrity. In some embodiments, a 70% to 90% difference or more may be suitable.

The thickened outer flange 17 of the heating element 16 has a downwardly sloped, slightly curved upper surface 42 extending downwardly from the junction 26 with the central panel section 24. The upper surface 42 terminates at its lower end 44 in a transversely extending lower surface 46 that extends to abut the roof eave edge 14.

The heating element 16 is held in position on the roof 12 by fasteners, e.g., 46, 48. In this embodiment, the outer panel section 28 fits under a roof and tightly abuts the lower side of a roof shingle 50, tile, or other outer roofing structure secured to the roof 12.

The heater cable 20 can be formed of one continuous heater cable. Such cable can consist of Tyco Thermal's GM-1X or GM-2X self regulating heater cable with an output of up to 12 watts per foot.

The power supply (not shown) is a 110V or 208-277V electrical circuit, typically connected in an electrical junction box is attached to the heater cable in a fashion well known in the art. Similarly, the heater cable is terminated at its end opposite the power supply in a fashion well known in the art.

The entire heating element 16 may be made of any material that can transfer heat generated by the heater cable 20. Some such materials include various metals, alloys, etc. One such metal is copper and another is mill finish 6063 aluminum alloy. In some embodiments, the heating element 16 is formed by extrusion, although any other suitable forming techniques may be utilized. The extruded heating element 16 is thus one unitary piece and transfers heat from the heater cable 20 throughout the heating element 16 to melt ice or snow on or sufficiently close to the heating element upper surface 52.

Figure 2:
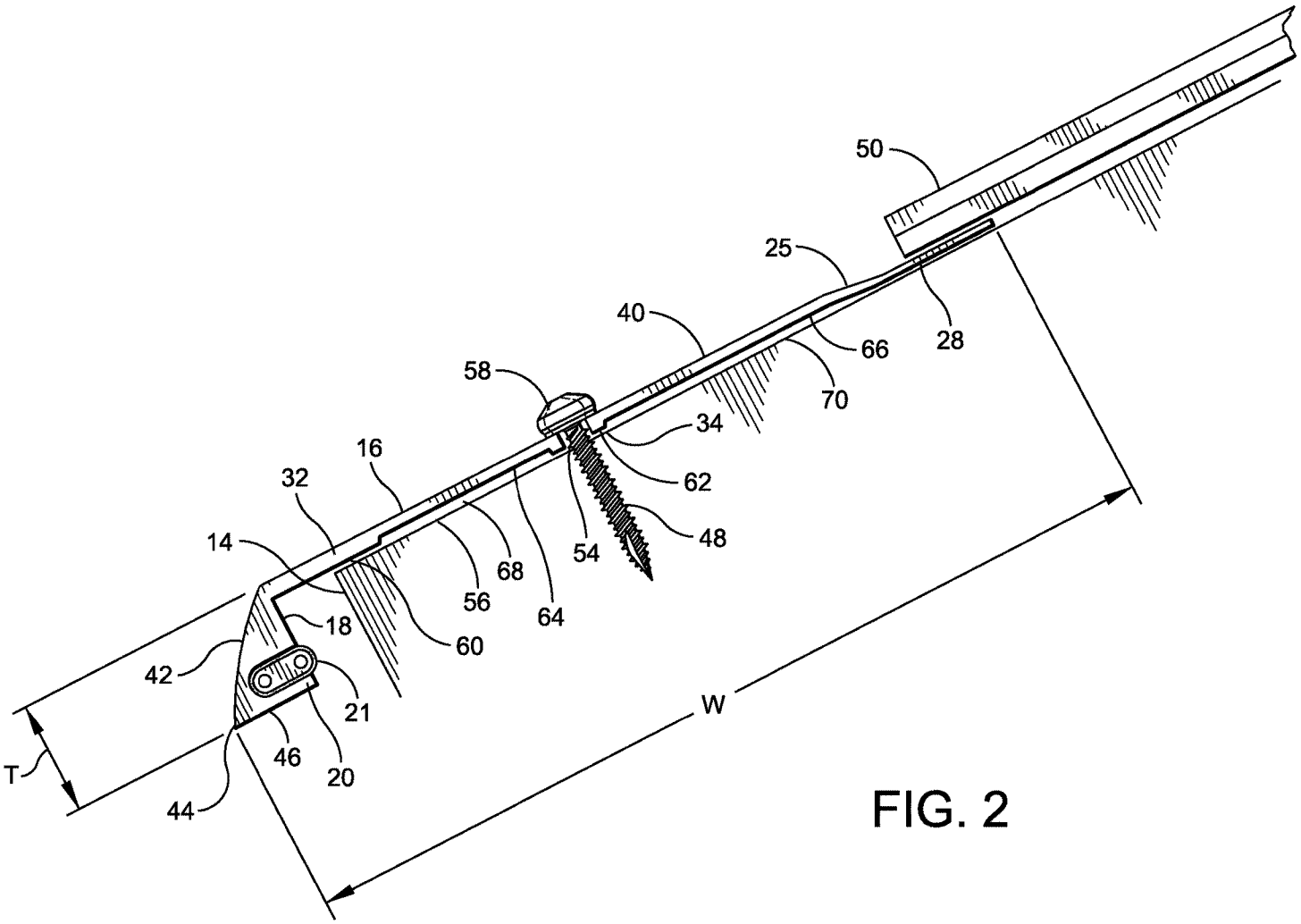
FIG. 2 is a partial cross-sectional view of the unitary heating cover embodiment of FIG. 1 mounted to the roof edge and upper roof surface.

With reference now to FIG. 2, the fastener 48 is a Torx T-25 pan head low profile screw with a waterproof gasket and metal dome washer. The fastener 48 penetrates a mating fastener passage 54 in the central support section 34 of the heating element 16 to penetrate the underlying, generally planar roof support surface 56. When threaded fully and tightly into position, the head 58 of the fastener 48 creates a seal between the fastener 48 and abutting upper surface of the central support section 38. The lower planar surfaces 60, 62 of each of the lower support section 32 and central support section 38, respectively, abut the roof support surface 56, thus providing insulating air spaces 68, 70 between the roof support surface 56 and planar lower surfaces 64, 66 of the intermediate section 36 and upper end section 40, respectively, of the heating element 16. In some embodiments, insulating material can be injected or otherwise placed within one or both of these spaces 68, 70.

When secured to the roof 12, the roofing structure, e.g., 50, and tightly abuts, and thus provides a seal between, the upper surface of the outer panel section 28. Similarly, the outer panel section 28 tightly abuts, and thus provides a seal between, the upper surface 56 of the roof 12.

In one embodiment, the heating element 16 is made of 6063-T6 aluminum and has a width W of 7.375 inches and thickness T of 0.943 inches. The weight of the heating system (the heating element 16, fasteners, e.g., 58, and heating cable) is 1.22 lbs. per lineal foot of lateral length of the system along the roof edge. The typical lateral length of the extruded heating element 16 is 96." These specifications can vary by application, however. One or more of these specifications can vary, for example, by plus or minus 20%, 40%, 80%, 120%, or more. The lateral length of the heating system may vary as desired. Pre-formed sections may be cut to length as desired and as is well to known those skilled in the art.

Embodiments of the heater system of FIG. 1 can be effective in most winter conditions experiences in most of the United States, such as for example in Lake Tahoe, Calif. At the same time, some embodiments of the FIG. 1 heating system can be reduce the cost of ordering, manufacturing, shipping and installing the product more affordable than comparable systems in the prior art.

Figure 3:
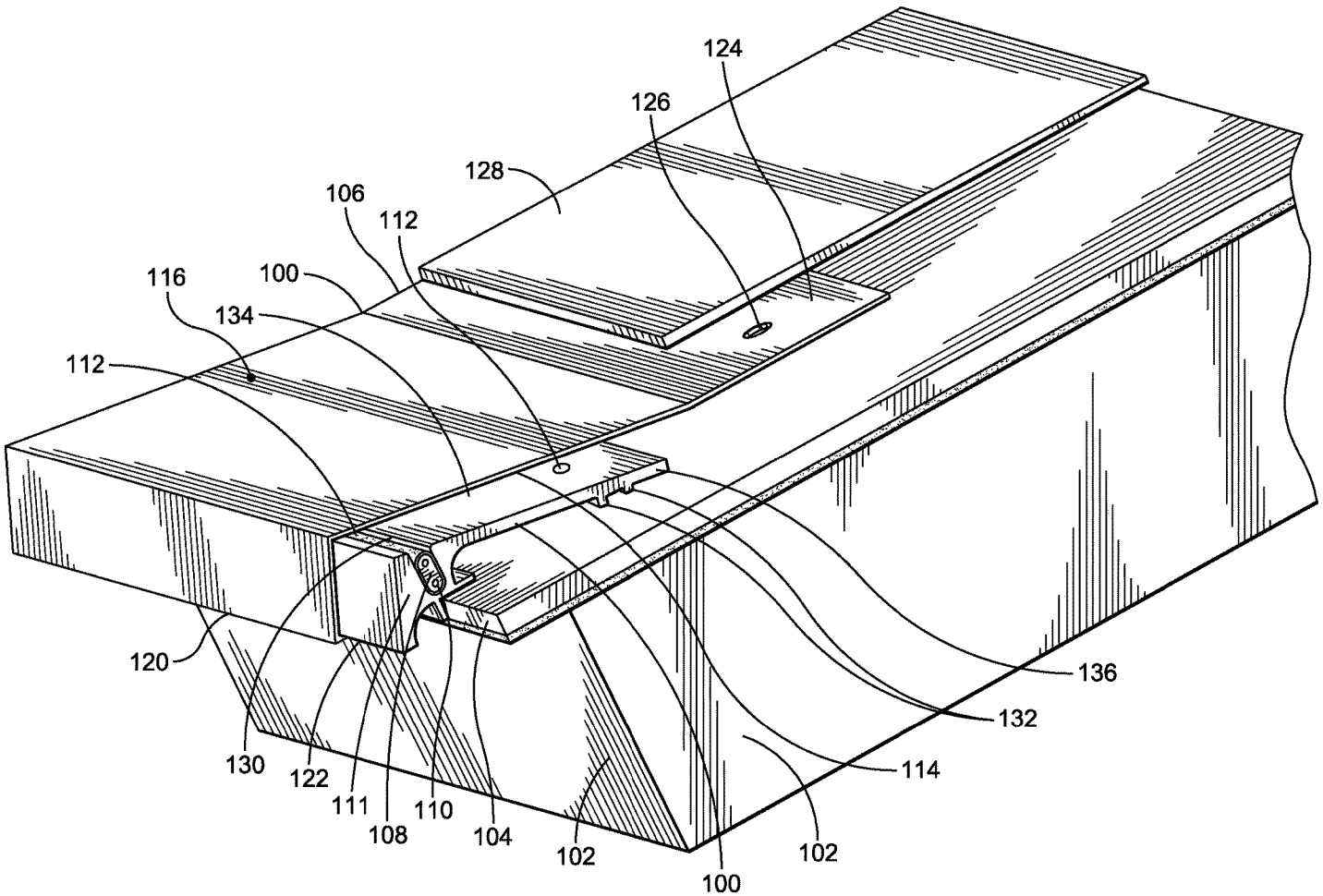
FIG. 3 is a perspective, partially cross-sectional view of an alternative embodiment of a structure heating system mounted about a roof edge on the roof of an underlying house, having a heating cover surrounding an underlying heating element and included heating cable.

In locations subject to more severe winter conditions, however, some embodiments of the heating-element-and-cabling-structure of FIG. 2 can provide a more reliable solution. With reference now to FIG. 3, this alternative heating system has: (i) a laterally extending heating element 100 mounted to an underlying roof 102 and roof edge 104; (ii) a laterally extending heat radiant heating element cover 106 surroundingly abutting the exposed portions of the heating element 100; (iii) a single heating cable 108 running through a heating cable channel 110 extending upwardly in the heating element flange 111 so that the upper end 112 of the heating cable 108 abuts the underside 114 of the heating element cover 106; and (iv) fasteners, e.g., 116, penetrating mating passages, e.g., 118, in the heating element cover 106 and heating element 100. The heating element cover 106 is held in position by (i) its wrap around, laterally extending lower edge 120 gripping the laterally extending lower edge 122 of the heating element flange 112 and (ii) at its opposed laterally extending upper end 124 by fasteners, e.g., 126, penetrating mating passages in the upper end 124, which underlies an abuts the lowermost shingles, e.g., 128, on the roof. 102.

The heating element 100 flange-support end 130 of the heating element 106 and upper end support section 132 are substantially thicker than (i) the relatively substantially thinner intermediate section 134 extending from the flange-support end 130 to the upper end support section 132, and (ii) the relatively substantially thinner upper end 136 extending upwardly along the roof from the upper end support section 132.

Figure 4:
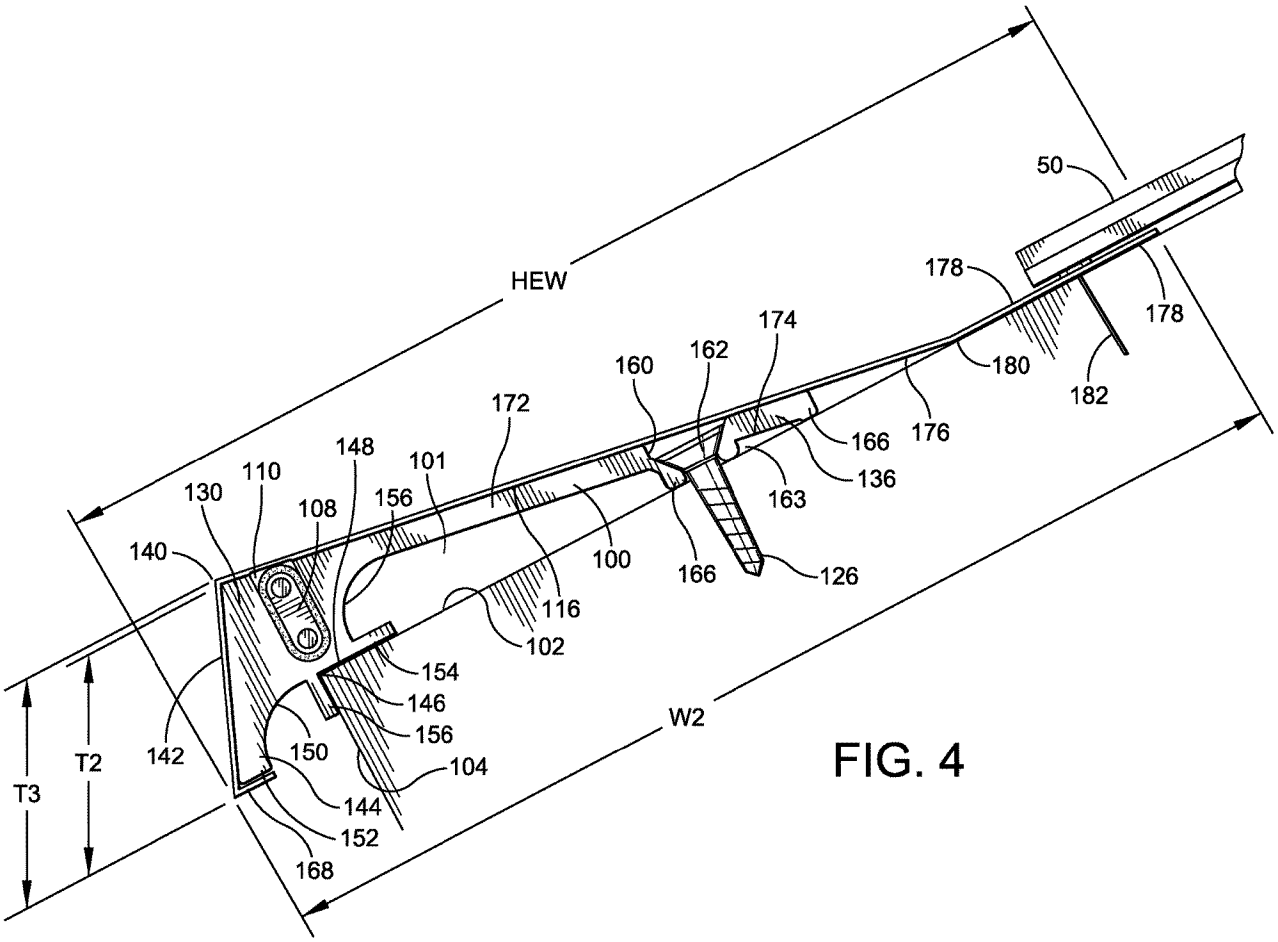
FIG. 4 is a partial cross-sectional view of the alternative embodiment of FIG. 5 mounted to the roof edge and upper roof surface, with the underlying heating element, which would normally be covered by the heating element cover panel, partially exposed.
Figure 5:
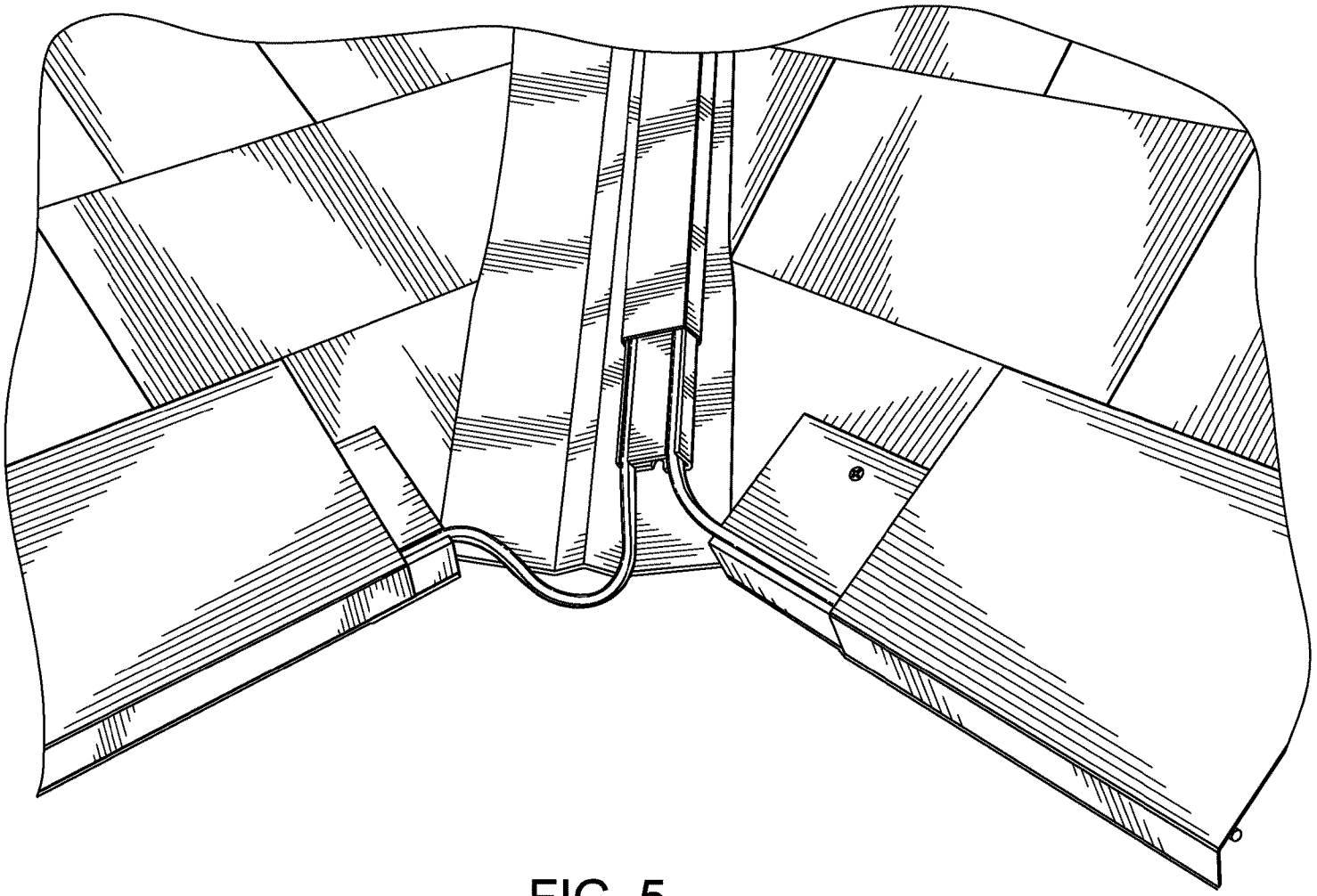
FIG. 5 is a photograph of an embodiment of the heating system of FIG. 3 mounted to a roof with a central heating cable distribution system for each of two heating elements and associate heating element covers extending from opposed roof edges.
Figure 6:
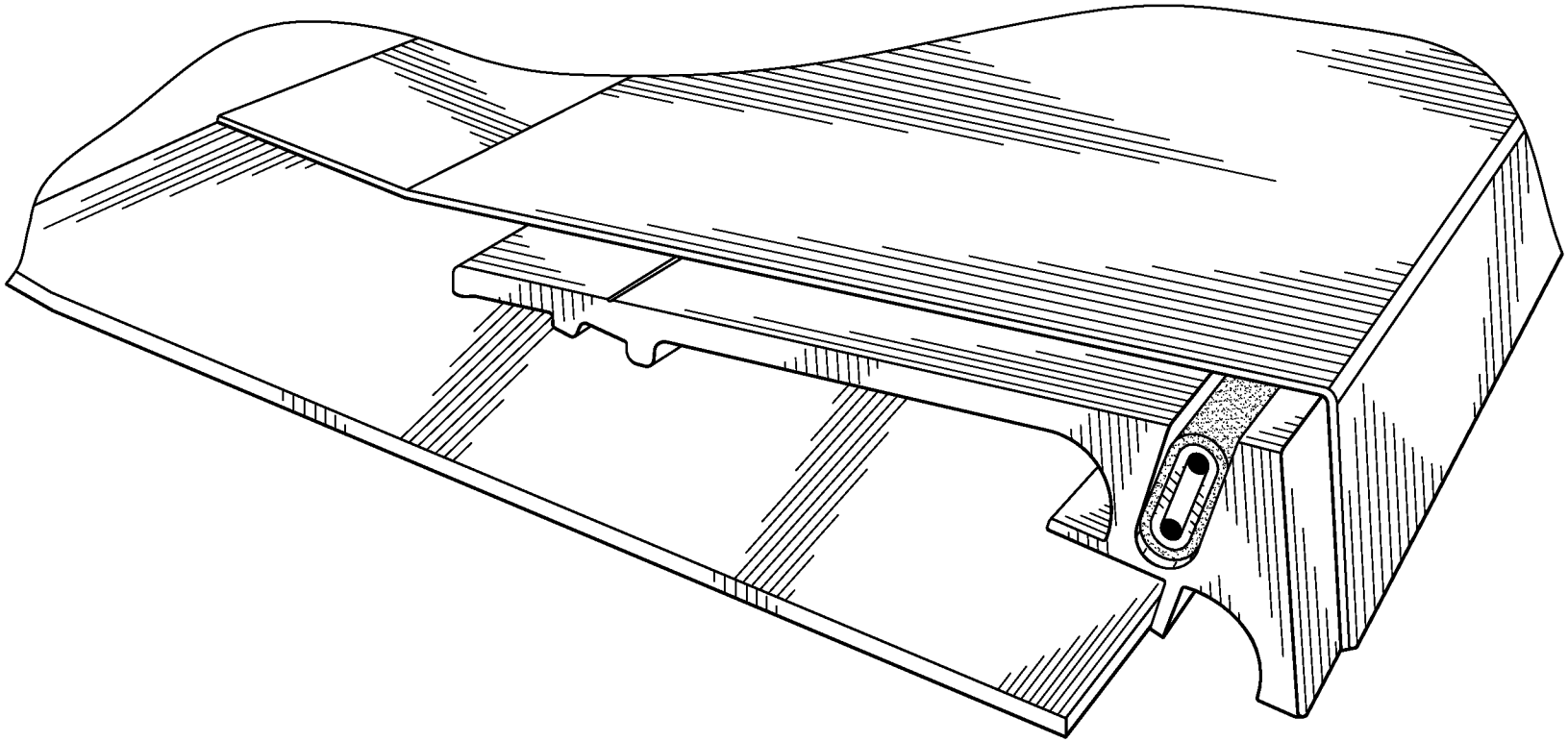
FIG. 6 is another photograph of the embodiment of FIG. 6 closer up and with the underlying heating element partially exposed.

With reference now to FIG. 4, the heating element 100 has a generally planar upper surface 138 extending from its upper end 136 to the lower peak edge 140 of the lower flange-support end 130. The heating element flange 111 extends downwardly from upper surface 138 to provide a planar side flange surface 142 at an acute angle to the plane of the upper surface 138. The downward extension of the flange 111 provides a lip 144 extending below, and spaced from, a flange mounting corner 146 that sealingly mounts about the upper edge 148 of the roof 102. The lip 144 has an interior radiused side 150 extending from the lowermost end 152 of the lip 144 to the mounting corner 146 while maintaining separation from the adjacent roof edge 104. The mounting corner 146 is provided by a thin wall section 158 extending transversely downwardly from the adjacent planar base 154 of the flange-support end 130. The U-shaped heating cable channel 110 extends upwardly above the mounting corner 146 between side flange surface 142 and a radiused or curved interior side 156 of the flange-support end 130.

The upper end support section 132 of the heating element 100 includes a fastener passage 160 through which the fastener 126 secures the heating element 100 to the roof surfaces 102 and also to provide a tight seal between the roof upper edge 148 and mounting corner 146. The lower surfaces 154, 164, 166 of the flange-support end 130, thickened upper end support section 132, and upper end 136 of the heating element 100 abut, and support the heating element 100 on, the roof support surface 102. The fastener passage 126 is countersunk into the upper end support section so that the fastener end 160 is seated entirely within the periphery of the fastener passage 126.

The heating cable 108 is mounted within heating cable channel 110 so that the cable tightly abuts the mating interior side wall of the channel 110. The heating cable 108 and heating element 100 thus transfer heat to mating abutting interior surface or underside 116 of the heating element cover 106. In contrast, the lower surfaces 154, 164, and 166 provide relatively little supporting contact with the roof surface 102 and thus relatively less area for heat transfer loss through those surfaces 154, 164, 166. In addition, the relatively thinner intermediate section 132 and upper end 136 of the heating element 100 are spaced from the opposed portions of the roof support surface 102, creating insulating air spaces 101, 103 or providing areas in which other types of insulating materials can be injected or otherwise placed. Further, insulating material can also be injected or placed in the space 105 between upper section 176 of the heating element cover 106 and the adjacent roof surface 102 below the upper section 176.

The heating element cover 106 has a lower gripping lip edge 168 abutting the lower end of the flange lip 144 and from there surrounds the mating outer planar upper surfaces 170, 172, 174 of the heating element 100. The upper section 176 of the heating element cover 106 extends upwardly to abut the roof surface 102 and at that contact point 180 extends in roof mounting section 178 angularly upwardly along the roof surface 102 under the roof shingle (or other roof structure) 50 abutting the top surface of roof mounting section 178. A corrosion resistant nail 182 is nailed through the roof mounting section 178 to underlie the roof shingle 50. The heating element cover 106 thus surrounds, and helps protect from the elements and debris, the entire otherwise exposed portions of the heating element 100, the heater cable 108 mounted in the heating element 100, and the screw fasteners, e.g., 126.

In the embodiment of FIG. 4, the heating element 100 is extruded (and thus unitary) and has a width HEW of 3.885 inches and a thickness T2 of 1.05 inches, and the heating element cover has width W2 of 11 inches and a thickness T3 of 1.27 inches. The weight of the FIG. 4 embodiment of the heating element 100 is as follows: the weight of the heating element cover or panel 106 is 0.59 lbs (if 6063 aluminum) or 1 to 1.25 lbs. (if copper) per linear foot; the weight of the heating element 100 is 3.85 lbs. per lineal foot if made of copper; the weight of the heating cable 108 is 0.09 lbs. per lineal foot; and the weight of the fasteners, e.g., 126, and nails, e.g., 182, is 0.01 ounces per lineal foot. The sizing and weight of these components may be adjusted in this embodiment just as described above for the FIG. 1 embodiment.

As compared to the Bylin RIM panel prior art system explained above, the particular dimensioned embodiment of FIGS. 3 and 4 provides: (i) 96% more heating top surface area on the cover panel 36; and (ii) 91% less convective contact area between the heating element and supporting roof structure. Lesser percentages may also be achieved by differing designs; greater percentages may be achieved too, such as, for example, by deletion of a central heater cable passage structure.

In the particular dimensioned embodiment of FIGS. 3 and 4 described above, the heating element's top surface is 3.27" wide. The applicant's prior Radiant Edge system has a Radiant Edge top surface cover panel that is 4.63" wide. This FIG. 1 embodiment thus has 30% LESS top surface area than Radiant Edge system.

In that FIG. 1 embodiment, the heating element's bottom surface in contact with the supporting roof is 0.108" wide. The Radiant Edge system's bottom surface in contact with the supporting roof is 0.645" wide. This particular FIG. 1 embodiment thus has 83% less contact area (heat transfer contact area with the supporting structure, such as roof upper surface and roof edge) than the Radiant Edge system.

In that Figure embodiment, heating element's cable/consumption utilizing a Self-regulating heater cable is 12 watts per foot of heating system as installed on a roof edge. The Radiant Edge system's cable/consumption is 24 watt per foot of heating system as installed on a roof edge. This particular FIG. 1 embodiment thus uses approximately 50% LESS energy to operate than Radiant Edge system.

The embodiments shown in the accompanying Figures also mitigate ice dam conditions by providing a downwardly extending water flow surface along the upper surface of the heating element (in the case of FIGS. 1 and 2) or heating element cover (in the case of FIGS. 3 and 4) and nearly vertical lower side edge, terminating in an upwardly extending lower side of the heating element or heating element cover as applicable.

As noted above, insulation may be utilized in conjunction with the heating systems. Certain types of insulation can also provide further support to the heating element 100 and, in turn, the cover 106. In some embodiments, the insulation may be preformed and mounted in or secured to the associated heating element portions.

Insulating sealants, plastic liners, paint, or other layering (not shown) may be mounted, inserted, or sprayed on one or more surfaces of the heating apparatus. For example, such insulating layers can be located between one or more mating sections of, e.g., a copper heating element cover 38 and, e.g., aluminum heating element 100, or between any other structures made of disparate metals or otherwise benefiting for any such liner or layer. Use of an insulating layer can reduce corrosion as well as help seal interior heating apparatus structure from exposure to humidity, water, debris, etc.

The heating apparatus can be utilized with other heating structure(s). For example, multiple heating elements and cover panels may be utilized as necessary to facilitate given objectives, such as size concerns in shipping. Additional heater cable section may be included to extend the heating cable into other structures, such as gutters and along roof valleys. Additional covers may be utilized such as copper cover panels of varying shapes such as might be utilized to cover a heating cable in a given location, such as a roof valley.

With regard to the embodiment of FIGS. 1 and 3, the heater cable channel and fastener support channel may be placed in differing locations while maintaining the objective of relatively maximizing heat transfer contact between the cover panel and heating element and relatively minimizing heat transfer contact between the heating element and supporting structure like an upper roof surface.

Differing cover panel shapes may be utilized. For example, the cover panel may be larger to extend further upward on a roof from its lower edge. The lateral ends of the cover panel, at one or both ends of the heating element may include extension portions that can be bent in position to surround and seal from the elements the heating element and/or associated heater cabling. In the alternative or in addition, other metal sheeting or cap structure may be mounted to or surrounding exposed or unsealed portions of either of the opposed lateral ends of the heating panel to seal the heating element or associated heater cable from the elements or debris.

In the embodiments described above, heat is distributed to the heating element by a heating cable. For example, a heating fluid may be utilized to distribute heat in heating channels or conduits in the heating element.

In one exemplary embodiment, the heating apparatus may be assembled as follows:

1. mounting and securing the heating element to a roof either to a roof deck or over existing roofing such as roof shingles, in some instances adjacent and surrounding somewhat a roof edge;
2. when applicable, mounting the heating cable in the heating cable channel in the heating element;
3. mounting and securing a cover panel to generally surround the heating element, and in some embodiments, extend over and/or under portions of the roof structure or otherwise beyond contact with the heating element.
4. if the heat source structure is electrical, connecting the heating cable structure to a power supply.

In some embodiments, the methods of installing disclosed herein may include adding an insulating layer at desired locations on the heating element or to the underside of the cover panel. The insulating layer(s) may be mounted to the heating element locations either before mounting the heating element or during or after such mounting. The insulating layer(s) may be added to the underside of the heating element cover at any point prior to mounting the cover to generally surround the heating element, depending on the nature of the insulating layer.

In some embodiments, the step of securing the heating element and/or cover panel to the roof may include inserting or otherwise utilizing an insulating washer or other insulating layer to be located between a metal fastener head and underlying structure on the heating element or heating element cover with which the head will be in contact. Further, in some embodiments, fastener components or materials other than or in addition to screws or nails may be used. For example, construction adhesive may be utilized in certain applications to fasten one structure or component to another abutting the structure or component.

Paint may be applied to exposed surfaces of the heating apparatus, such as the upper surface of the cover panel, to achieve desired aesthetics. Metallic paint may be used to improve heat transfer through the paint.

It can thus be seen that some heating apparatus embodiments of the type shown in the accompanying Figures can thus provide more efficient, reliable, and easily manufactured, mounted, used, and maintained heating system than prior art systems for applicable environments. Some heating element embodiments can provide substantially more heat transfer to the cover panel and substantially less heat transfer to the supporting roofing structure.

As used herein, spatial or directional terms, such as upwardly, downwardly, lower, and the like, relate to the subject matter as it is shown in the drawing figures. However, it is to be understood that the subject matter described herein may assume various alternative orientations and, accordingly, such terms are not to be considered as limiting or requiring and orientation in space. Furthermore, as used herein (i.e., in the claims and the specification), articles such as "the," "a," and "an" can connote the singular or plural. Also, as used herein, the word "or" when used without a preceding "either" (or other similar language indicating that "or" is unequivocally meant to be exclusive—e.g., only one of x or y, etc.) shall be interpreted to be inclusive (e.g., "x or y" means one or both x or y). Likewise, as used herein, the term "and/or" shall also be interpreted to be inclusive (e.g., "x and/or y" means one or both x or y). In situations where "and/or" or "or" are used as a conjunction for a group of three or more items, the group should be interpreted to include one item alone, all of the items together, or any combination or number of the items. Moreover, terms used in the specification and claims such as have, having, include, and including should be construed to be synonymous with the terms comprise and comprising.

The terms recited in the claims should be given their ordinary and customary meaning as determined by reference to relevant entries (e.g., definition of "plane" as a carpenter's tool would not be relevant to the use of the term "plane" when used to refer to an airplane, etc.) in dictionaries (e.g., widely used general reference dictionaries and/or relevant technical dictionaries), commonly understood meanings by those in the art, etc., with the understanding that the broadest meaning imparted by any one or combination of these sources should be given to the claim terms (e.g., two or more relevant dictionary entries should be combined to provide the broadest meaning of the combination of entries, etc.) subject only to the following exceptions: (a) if a term is used herein in a manner more expansive than its ordinary and customary meaning, the term should be given its ordinary and customary meaning plus the additional expansive meaning, or (b) if a term has been explicitly defined to have a different meaning by reciting the term followed by the phrase "as used herein shall mean" or similar language (e.g., "herein this term means," "as defined herein," "for the purposes of this disclosure [the term] shall mean," etc.). References to specific examples, use of "i.e.," use of the word "invention" or similar terms are not meant to invoke exception (b) or otherwise restrict the scope of the recited claim terms. Other than situations where exception (b) applies, nothing contained herein should be considered a disclaimer or disavowal of claim scope. The subject matter recited in the claims is not coextensive with and should not be interpreted to be coextensive with any particular embodiment, feature, or combination of features shown herein. This is true even if only a single embodiment of the particular feature or combination of features is illustrated and described herein. Thus, the appended claims should be read to be given their broadest interpretation in view of the prior art and the ordinary meaning of the claim terms.

What I claim is:

1. A roof edge heating apparatus mountable adjacent an edge of a roof of a building, the roof edge heating apparatus comprising in combination:

A. a unitary cover laterally-extending heating element providing a laterally-extending heating element section extending from a thickened outer flange that extends laterally and below the laterally-extending cover;

B. a single heating cable channel formed in the thickened outer flange of the unitary cover, the heating cable channel laterally extendable along an underside of the unitary cover heating element adjacent the edge of the roof of the building, the channel having an open portion adjacent the edge of the roof intermediate an enclosed channel element having an upper channel side, a lower channel side and a distal channel side extending between the upper channel side and lower channel side distal from the edge of the roof;

C. a heating cable mountable in the heating cable channel through the open portion of the heating cable channel, with the heating cable abutting the upper, lower, and distal sides of the heating cable channel, wherein the open portion is positioned to receive the heating cable transversely; and D. a fastener passage in the laterally-extending heating element section for fastening the cover heating element adjacent the edge of the roof.

2. The roof edge heating apparatus of claim 1 wherein the roof edge heating apparatus includes a roof edge seal abuttable against the edge of the roof.

3. The roof edge heating apparatus of claim 1, wherein the unitary cover has a thin heating section adjacent a top surface of the roof, the thin heating section having a predominantly planar upper surface and being thinner in an upper portion than the thickened outer flange.

4. The roof edge heating apparatus of claim 3 wherein differing thicknesses provide a plurality of support surface contact areas and the unitary cover provides an upper heating surface having an upper heating surface area at least 60% greater than the support surface contact areas.

5. The roof edge hearing apparatus of claim 4 wherein the heating cable channel is U-shaped.

6. The roof edge heating apparatus of claim 4 wherein the unitary cover heating element comprises copper or aluminum.

7. The roof edge hearing apparatus of claim 1 wherein the heating cable channel is U-shaped.

8. The roof edge heating apparatus of claim 7 wherein the unitary cover heating element comprises copper or aluminum.

9. The roof edge heating apparatus of claim 1 wherein the unitary cover heating element comprises copper or aluminum.

* * * * *